US005143008A

United States Patent [19]

Hall

[11] Patent Number: 5,143,008

[45] Date of Patent: Sep. 1, 1992

[54] SAILBOARD

[76] Inventor: Lawrence W. Hall, 675 4th St., Hermosa Beach, Calif. 90254

[21] Appl. No.: 729,704

[22] Filed: Jul. 15, 1991

[51] Int. Cl.[5] ..... B63H 25/06

[52] U.S. Cl. ..... 114/39.2; 114/114 R; 114/161; 441/74

[58] Field of Search ..... 114/39.2, 43, 144 R, 114/363, 161; 441/65, 67, 74, 75, 76, 79; 280/14.1, 14.2

[56] References Cited

U.S. PATENT DOCUMENTS

| | | | |
|---|---|---|---|
| 4,194,458 | 3/1980 | Messing | 114/39.2 |
| 4,478,164 | 10/1984 | Menear | 114/39.2 |
| 4,604,959 | 8/1986 | Menear | 114/39.2 |
| 4,678,444 | 7/1987 | Monreal | 441/65 |
| 4,679,516 | 7/1987 | Friesen | 114/39.2 |
| 4,730,568 | 3/1988 | Campbell | 114/39.2 |
| 4,771,723 | 9/1988 | Friesen | 114/39.2 |
| 4,850,916 | 7/1989 | Phillips | 441/74 |

*Primary Examiner*—Jesus D. Sotelo

*Attorney, Agent, or Firm*—Knobbe, Martens, Olson & Bear

[57] ABSTRACT

A windsurfing board or sailboard is shown having a dash for supporting a sailboarder and an improved rudder gear assembly. The dash projects upward from the sailboard and is positioned such that the sailboarder may prop his shins against the dash for support and balance. The improved rudder gear assembly provides a series of intermeshed gears whereby the sailboarder may control a rudder by turning the gears with his or her feet.

22 Claims, 6 Drawing Sheets

SAILBOARD

BACKGROUND OF THE INVENTION

The present invention relates to a one person wind-propelled sailing craft commonly referred to as a wind-surf board or a sailboard. The art of sailboard design has rapidly developed as a consequence of the growing popularity of the sport of sailboarding.

Several aspects of sailboards have been the subject of sailboard manufacturing and of patents relating to sailboards. In particular, many prior art patents disclose different types of mast-boom-sail assemblies. Related to this, a number of developers have devised different joint assemblies between the mast and the sailboard to permit improved movement characteristics of the sail relative to the sailboard.

Most conventional sailboards are not equipped with rudders for steering, but rather are provided with centerboards or dagger boards which serve primarily to provide stability to the sailboard. A few prior art patents disclose sailboards which allow a sailboard sailor (sailboarder) to control movement of a rudder by means of his or her feet. Sailor-controllable rudders are desirable in order to better enable a sailboarder to steer his sailboard in desired direction of travel. Unfortunately, a sailboarder's hands are continuously occupied with holding and the sail and thus are not available to be devoted to a rudder. U.S. Pat. Nos. 4,679,516 and 4,771,723 disclose inventions for an aft-mounted rudder which may be controlled by the sailboarder by means of a foot controlled steering assembly, and which is used in addition to a centerboard. U.S. Pat. No. 4,850,916 discloses an aft-mounted sailor-controllable rudder which is used in place of a centerboard.

SUMMARY OF THE INVENTION

The present invention is a sailboard having an improved foot-operable rudder control mechanism. The invention includes a support wall or dash formed on the upper surface of the sailboard. The dash is a slightly flexible formation which projects upward from the upper surface of the sailboard. Preferably, the dash is located fore of the position on the sailboard where a sailboarder stands during sailing, and is oriented orthogonal to the longitudinal length of the sailboard. The dash is formed and positioned such that the sailboarder operating the craft and holding the sail assembly with his hands may place his legs, preferably his shins, against the dash. The dash serves as a fulcrum so that the sailboarder gains support and superior leverage against the pull on the sail assembly caused by the wind. In the preferred embodiment, the dash is designed to flex somewhat in response to pressure of the sailboarder's legs against the dash so as to provide additional comfort to the sailboarder's legs.

A foot-operable rudder control is provided on the upper surface of the sailboard craft. The sailboarder may control a rudder underneath the sailboard by manipulation of the foot controls, thereby freeing his hands for grasping and controlling the sail assembly.

A significant feature of the present invention is that it aids a sailboarder in maintaining his balance on the board while simultaneously being able to control a rudder with his feet. In the prior art, attempts to solve this problem by devising a means whereby one's feet would control rudder movement have proven difficult because one's feet tend to continually shift position on the sailboard during sailing. This is due to the force transferred by the wind to the sailor via the sail and the consequent need to adjust one's balance to gain the necessary leverage and body weight applied against the direction of pull of the sail in order to remain upright on the sailboard. As a result, it has been extremely difficult to be able to maintain one's feet in a single place, such as is required in a foot-operated rudder control in order to be able to manipulate the rudder and hence steer the sailboard.

Another feature of the present invention is that it provides a sailboarder with a means for obtaining superior leverage against the pull of the sail and for aiding the sailboarder in maintaining his balance and supporting himself on a sailboard.

DETAILED DESCRIPTION OF THE PREFERRED EMBODIMENT

Figure 1:
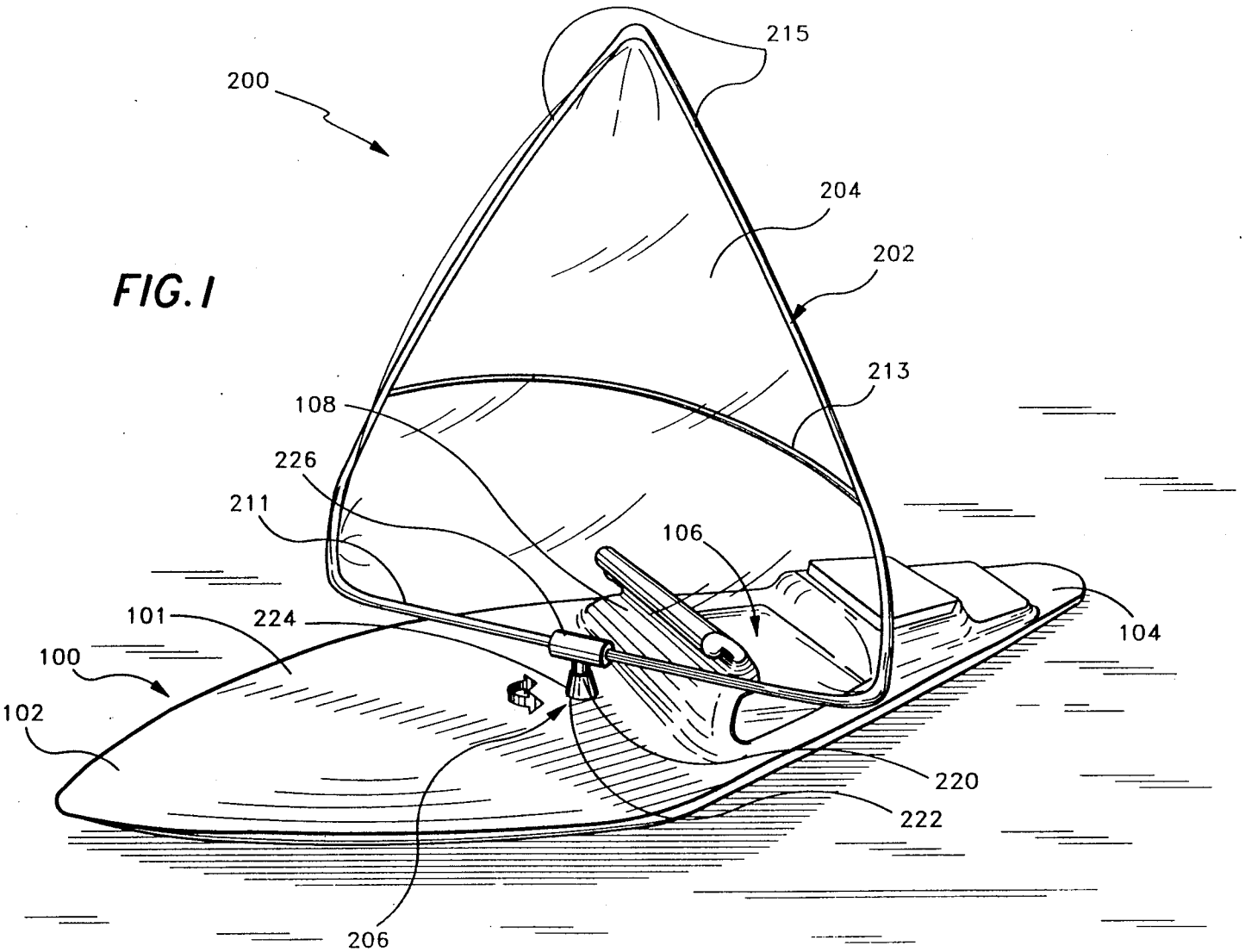
FIG. 1 is a perspective view of a sailboard, which is the preferred embodiment of the present invention, showing a sailboard, sail assembly and dash.
Figure 2:
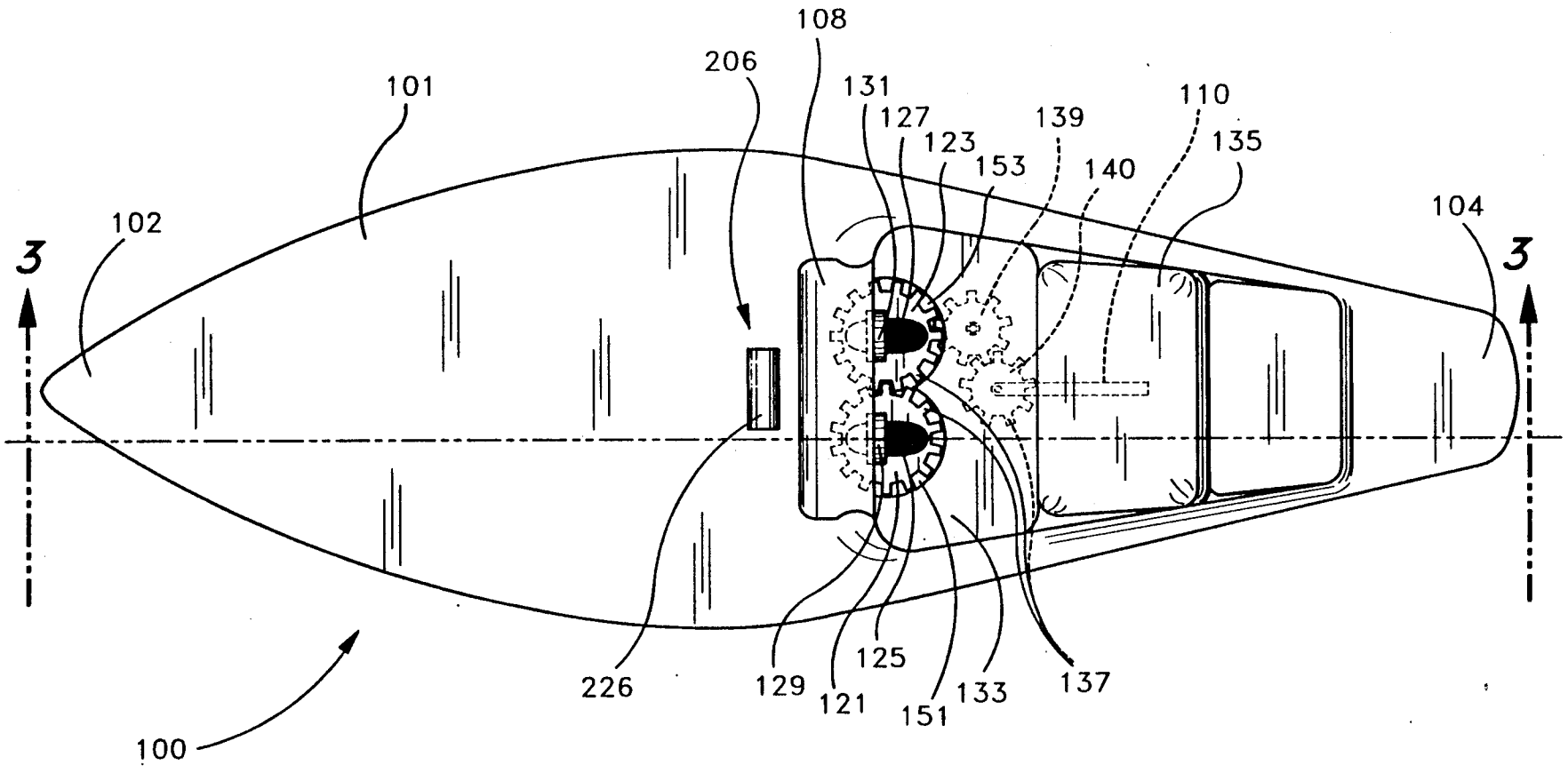
FIG. 2 is a top plan view of the sailboard of FIG. 1 without the sail assembly.
Figure 3:
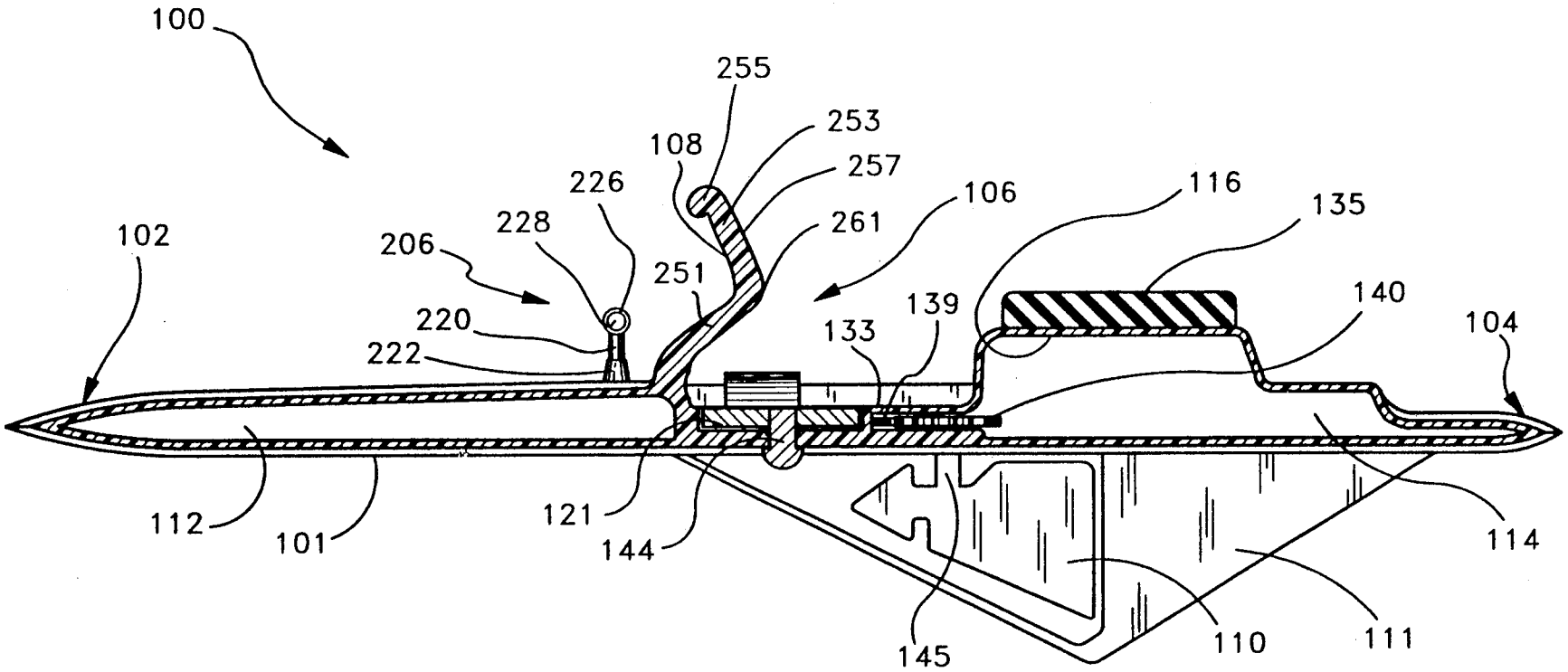
FIG. 3 is a cross-section of the sailboard taken along line 3—3 in FIG. 2.

Referring to FIGS. 1, 2 and 3, the improved wind-surfing board or sailboard 100 comprises an elongated, substantially hollow shell 101 having a tapered front end or prow 102 and a tapered rear end or stern 104. The board 100 is preferably formed substantially from a rigid, relatively light material such as, for example, fiberglass. Hollowed-out portions of the shell 101 comprise a hollow forward portion 112 and a hollow rear portion 114 (FIG. 3). These hollow portions 112 and 114 are airtight and are of sufficient volume to provide adequate buoyancy such that the sailboard 100 and a sailboarder thereon will easily stay afloat. As shown in FIG. 3, a rudder 110 projects downward from the bottom of the sailboard 100. A rudder guard 111 is mounted on and projects down from the bottom of the sailboard 100 to protect the rudder 110 from damage.

A cockpit 106 is formed approximately midway along the length of the board 100, as shown in FIGS. 1 and 3. The cockpit 106 is a hollowed-out area recessed into the upper surface of the board 100. The sailboarder advantageously pilots the sailboard 100 from within the cockpit 106. The cockpit 106 includes a dash 108 at the fore end thereof, a rudder gear assembly 109 on a floor 133 of the cockpit 106 and a seat 135.

Figure 4:
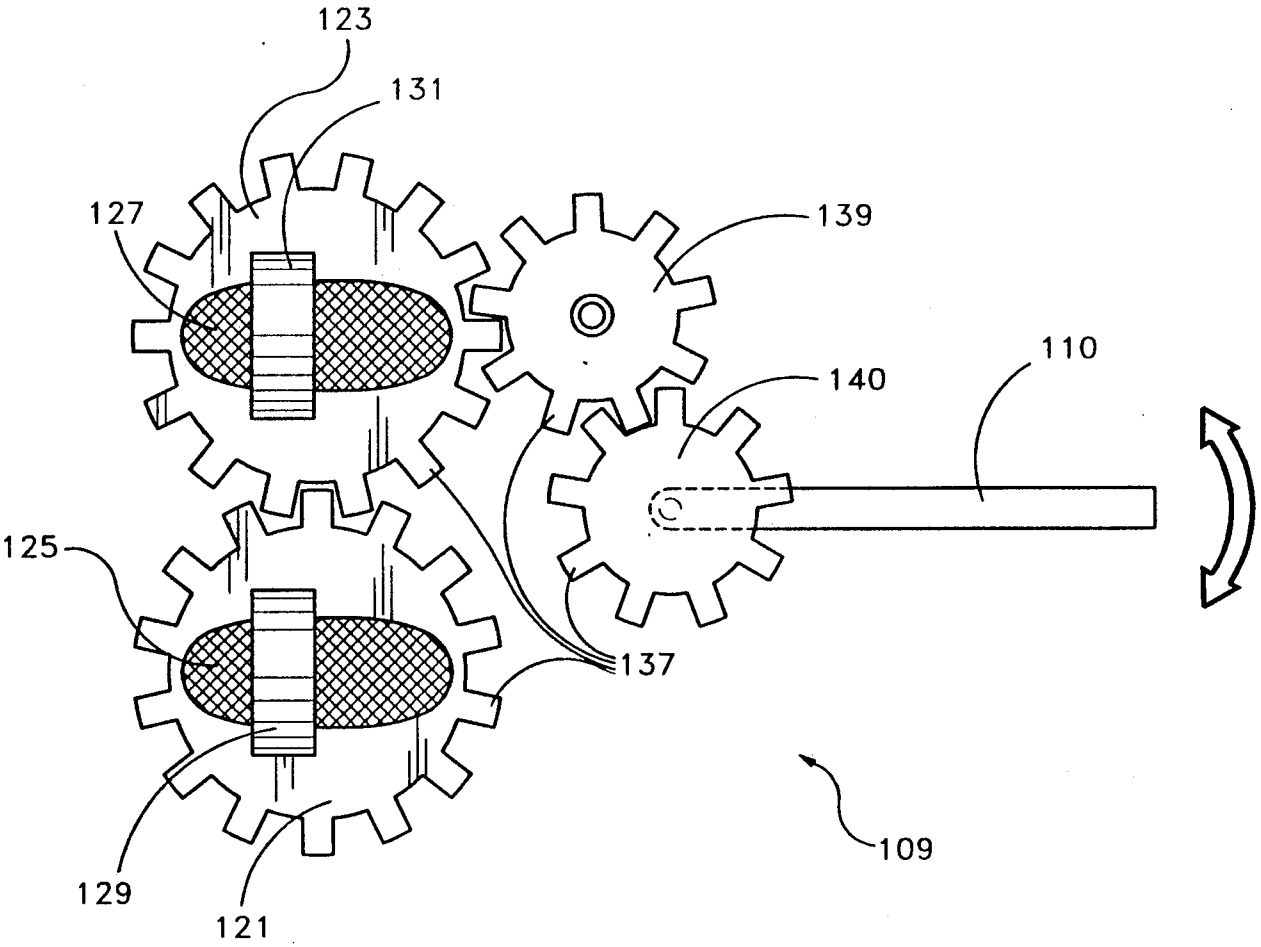
FIG. 4 is a top plan view of a gear assembly of the present invention.
Figure 5:
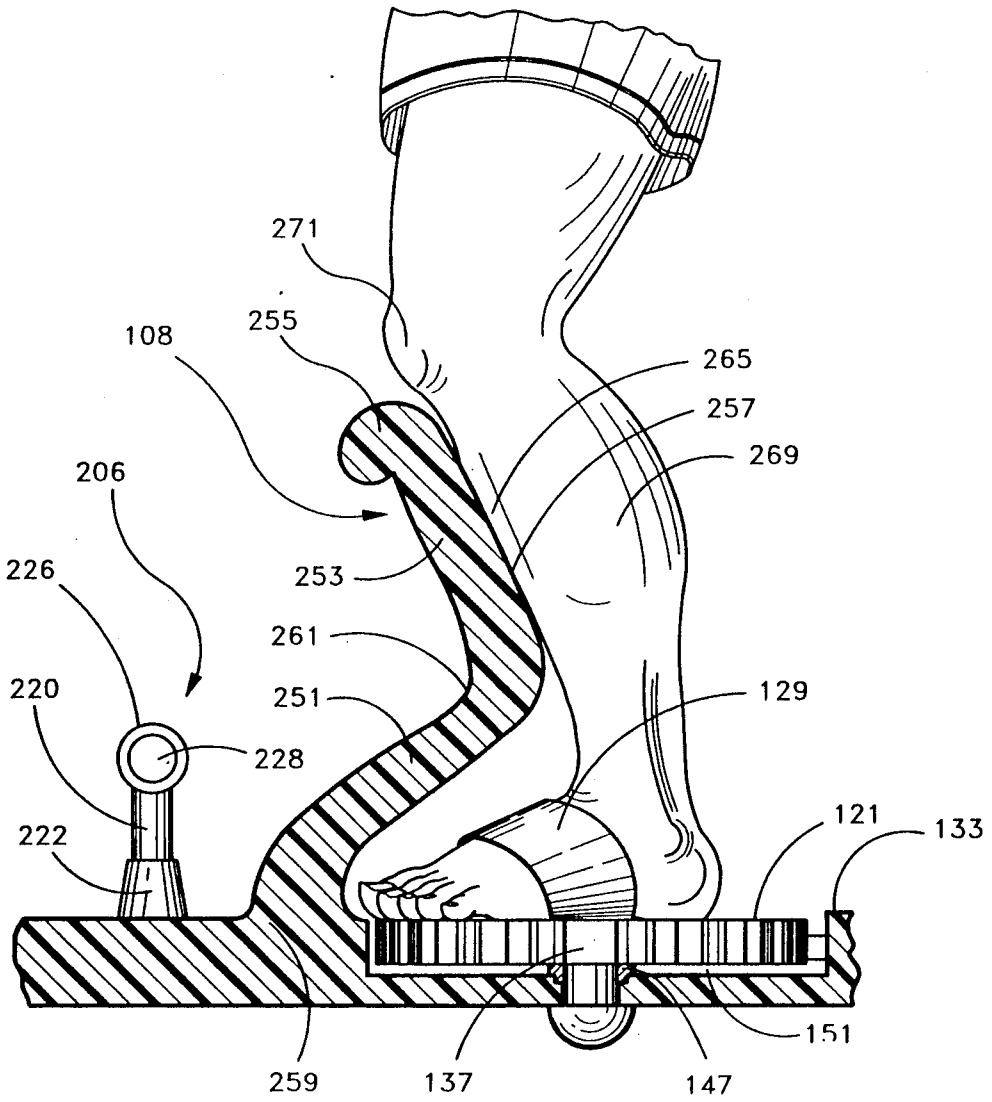
FIG. 5 is a partial cross-section of the cockpit portion of the present invention.

As best seen in FIGS. 2 and 4, the rudder gear assembly 109 includes a left rudder gear 121, a right rudder gear 123, a left foot pad 125, a right foot pad 127, a left foot strap 129 and a right foot strap 131. The left and right rudder gears 121 and 123 are toothed wheels rotatably mounted within respective and correspondingly sized left and right circular recesses 151 and 153 in the cockpit floor 133. As seen in FIG. 3, the upper surfaces of the gears 121 and 123 are flush with the cockpit floor 133. The gears 121 and 123 are mounted respectively onto a left gear shaft 144 (FIG. 3) and a right gear shaft (not shown) which are mounted into the board 100 through holes in the bottom surface thereof. The gears 121 and 123 are rotatably supported by bearings 147 (FIG. 5).

As seen best in FIG. 4, the gear assembly 109 also comprises a first control gear 139 and a second control gear 140. As shown in FIG. 3, these control gears 139 and 140 are preferably mounted inside the board 100 such that they are not externally exposed on the cockpit floor 133. The first control gear 139 is mounted slightly aft of the right rudder gear 123 and is preferably somewhat smaller in diameter than the right rudder gear 123. The second control gear 140 is mounted to the left and slightly aft of the first control gear 139 such that the second control gear 140 is positioned centered midway along the width of the board 100. A rudder shaft 145 (FIG. 3) is rigidly attached and mounted to the bottom of the second control gear 140. The rudder shaft 145 projects downward through the bottom surface of the board 100 and is integral with the rudder 110.

All of the gears 121, 123, 139 and 140 are formed with gear teeth 137 around the respective outer perimeters thereof. As seen in FIG. 4, the gears 121, 123, 139 and 140 are appropriately and cooperatively positioned in the cockpit floor 133 such that the gear teeth 137 of adjacent gears are meshed together. All of the four gears are so coupled that the rotation of either of the rudder gears 121 and 123 causes counter-rotational movement of the control gear 140 and rudder shaft 145. More specifically, the left rudder gear 121 is meshed to the right rudder gear 123, which is in turn meshed to the first control gear 139, which is in turn meshed to the second control gear 140.

The left foot pad 125 and a right foot pad 127 are formed respectively on the upper surfaces of the left rudder gear 121 and the right rudder gear 123. The foot pads 125 and 127 have the general shape of a foot and have an abrasive, non-slip surface, for example a rubber tread, attached or formed onto the upper surface of the gears 121 and 123. The left rudder gear 121 and right rudder gear 123 are also provided respectively with a left foot strap 129 and a right foot strap 131. The foot straps 129 and 131 are preferably made from a durable, soft material, for example nylon, and are mounted on the upper surface of the respective rudder gears 121 and 123 in a manner such that they span the respective foot pads 125 and 127.

Aft of the cockpit floor 133, a raised portion of the board 100, or a seat base 116, having a flat, upper surface is formed. A firm, waterproof cushion or seat 135 may be mounted on the flattened upper surface of the seat base 116.

As can be seen in FIG. 1, in the preferred embodiment of the present invention, the dash 108 comprises an integral angled wall which projects upward from the sailboard 100 and which is orthogonal to the longitudinal axis of the sailboard 100. The dash 108 extends from the port side of the board 100 to the starboard side. Vertically, the dash 108 extends, for example, approximately 16 inches above the level of the floor 133 of the cockpit 106, and extends rearward approximately 4 inches from the fore of the cockpit 106. The dash 108 is advantageously formed from a rigid yet somewhat flexible material, for example supple plastic or neoprene. Referring also to FIG. 5, which is the fore portion of the cockpit 106 shown in cross-section, the dash 108 is integral with the sailboard 100 and is formed with the board 100 at an insertion location 259 immediately fore of the cockpit 106. The dash 108 has an upward and rearward extending lower portion 251 which curves forward at an elbow 261 into an upward and forward extending upper portion 253. Preferably, the upper portion 253 of the dash 108 terminates in a brief, forward turning curl 255. The upper portion 253 of the dash 108 has a substantially flat, slightly upturned, aft-facing surface or rear face 257.

Referring again to FIG. 1, a sail assembly mounting or swivel mounting 206 is mounted on the upper surface of the board 100 slightly fore of the dash 108. The swivel mounting 206 comprises a shaft 220, a support ring 222, and a glove 226. The shaft 220 is cylindrical and vertically oriented and is rotatably mounted into the board 100. The glove 226 is a hollow, horizontally oriented cylinder having a longitudinal opening 228 (FIG. 5) therethrough. The shaft 220 and glove 226 are rigidly connected.

Referring still to FIG. 1, a sail assembly 200 includes a sail frame 202 and a sail 204. In the preferred embodiment, the sail frame 202 is a triangular structure having two angled side bars 215 and a bottom horizontal bar 211. In addition, a curved cross bar 213 is connected to and spans between the two side bars 215 aft of the sail 204. The sail 204 is attached to the two side bars 215 and the horizontal bar 211 such that the sail 204 is stretched within the triangular structure of the frame 202. The horizontal bar 211 is swivably mounted through the opening 228 of the glove 226. This mounting is snug but not rigid such that the sail assembly 200 has freedom to rotate forward and rearward about an axis defined by the horizontal bar 211.

In use, a sailboarder mounts the sailboard 100 and positions himself within the cockpit 106. As with conventional sailboards, a pull string (not shown) attached to the sail assembly 200 may be provided to assist the sailboarder in pulling the sail assembly 200 out of the water. When the sail assembly 200 is pulled up, the sailboarder grasps the cross bar 213 with both hands and places his feet on the respective left foot pad 125 and right foot pad 127 and within the respective left foot strap 129 and right foot strap 131.

Figure 6:
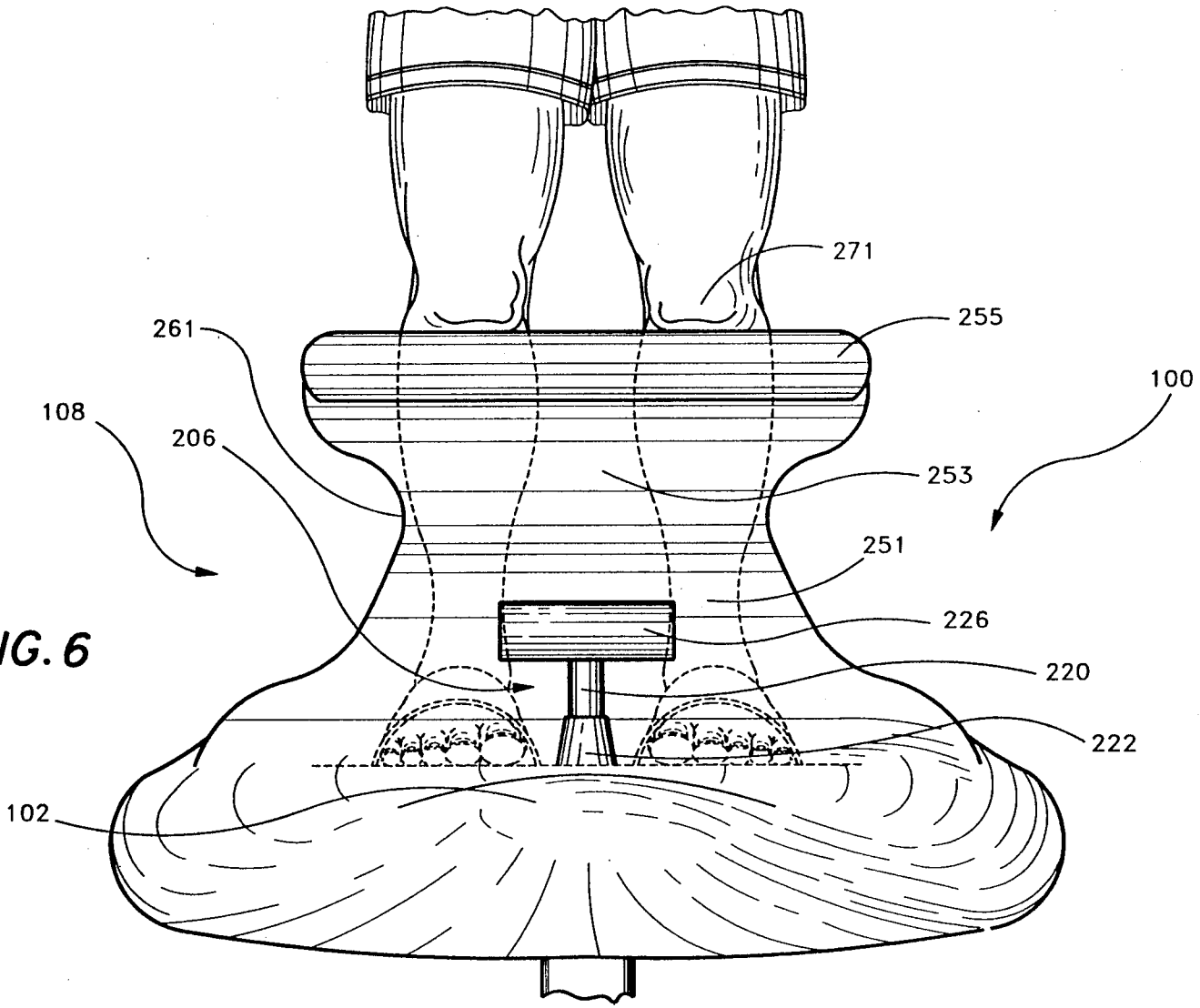
FIG. 6 is a frontal view of the sailboard and dash.

When wind catches the sail 204, the sail assembly 200 is pushed forward which consequently pulls the sailboarder forward. In accordance with one aspect of the present invention, in order to leverage himself against the pulling force of the sail 204, the sailboarder supports himself by pressing his shins 265 against the dash 108 which provides a large support surface (see FIGS. 5 and 6). By placing his shins 265 against the dash 108, the sailboarder is able to support himself upright and to leverage himself against being pulled off the board 100 by the sail 204 without the necessity of continuously moving his feet to maintain his balance. The rear face 257 of the upper portion 253 of the dash 108 is formed at an angle to correspond to the approximate positioning of the sailboarder's shins 265 during sailing. As seen in FIG. 5, the knees 271 of the sailboarder are somewhat flexed and the lower legs 269 angle forward. The result is that the sailboarder's shins 265 will lie flat against the rear face 257 of the dash 108. The dash 108 is designed to flex somewhat at the elbow 261 in response to forward pressure exerted by the sailboarder's lower legs 269.

By placing his feet within the respective foot straps 129 and 131, the sailboarder restricts his feet from sliding and the sailboarder's feet are thus kept firmly in place upon the respective foot pads 125 and 127. In this manner, the force of the wind applied against the sail 204 is transferred to the sailboarder, and then from the sailboarder to the dash 108 and to the cockpit floor 133 via the rudder gears 121 and 123. The force of the wind is thereby imparted to the sailboard 100 which is thus caused to move forward.

Referring to FIG. 2, in accordance with another aspect of the present invention, the left rudder gear 121 and right rudder gear 123 are provided to allow the sailboarder to steer the sailboard 100 by manipulation of the rudder 110 (FIG. 3) via the control gears 139 and 140. Referring to FIG. 4, for a port tack, the sailboarder rotates his knees toward each other. The balls of his feet then rotate toward each other, thus causing the left rudder gear 121 to rotate clockwise and the right rudder gear 123 to rotate counterclockwise. Because the first control gear 139 is meshed with the right rudder gear 123 via their respective gear teeth 137, this causes the first control gear 139 to be rotated clockwise. This, in turn, causes the second control gear 140 to rotate counterclockwise via its meshing with the first control gear 139. As a result, the rudder 110, which is rigidly connected to the second control gear 140, is rotated in a counter-clockwise direction, and thus the rear of the rudder is caused to be turned toward the starboard (right) side of the sailboard. This causes the sailboard 100 to steer to the right. If the sailboarder's knees are rotated away from each other, for a starboard tack, the rotational direction of all of the respective gears is reversed and thus the rudder 110, and hence the sailboard 100, is caused to be turned to the left.

It will also be noted that the dash 108 and the rudder gear assembly advantageously work together to effect an improved steering apparatus. Specifically, the dash 108 serves as a balancing support for the sailboarder when the sailboarder turns the respective rudder gears 121 and 123. More particularly, the sailboarder is able to achieve greater balance by pressing or leaning his shins 265 against the rear face 257 of the dash 108. This improved balance allows greater ease in turning the rudder gears 121 and 123 and thus permits easier steering of the board 100.

Having described the invention in connection with certain specific embodiments thereof, it is to be understood that further modifications may now suggest themselves to those skilled in the art, and it is intended to include such modifications as fall within the scope of the appended claims.

I claim:

1. A wind-propelled sailboard craft which enables the sailboarder to obtain superior leverage against the pull of a sail, which aids the sailboarder in maintaining balance, and which enables the sailboarder to steer the sailboard by controlling a rudder with his or her feet, comprising:

a sailboard;

a rudder rotatably mounted on said sailboard;

a sail assembly mounted on said sailboard;

a swivel mounting for swivably mounting said sail assembly on said sailboard;

a cockpit formed on an upper surface of said sailboard, said cockpit being configured to enable a sailboarder to stand upright therein, and said cockpit being positioned aft of said mounting such that the sailboarder may grasp said sail assembly with his or her hands to control said sail assembly;

a dash formed on and projecting upward from said upper surface of said sailboard proximal said mounting, said dash positioned such that a sailboarder operating said sailboard and grasping said sail assembly may place his shins against said dash in order to gain support and leverage against the pulling force of said sail such that the sailboarder may more easily retain balance while operating said sailboard; and a foot-operable rudder control assembly coupled to said rudder so that the sailboarder may turn said rudder by manipulation of said rudder control assembly with his or her feet, said dash serving as a balancing support for the sailboarder when the sailboarder uses his or her feet to operate said foot-operable rudder control assembly.

2. In a wind-propelled sailboard craft which comprises a sailboard and a sail assembly mounted on said sailboard for propelling said craft over water, a means for advantageously assisting a sailboarder in maintaining balance upon said sailboard and for gaining leverage against the pull of said sail assembly caused by the wind in said sail assembly, said means comprising:

an integral dash formed on and projecting upward from an upper surface of said sailboard proximal said sail assembly, said dash positioned such that a sailboarder operating said sailboard and grasping said sail assembly may place his shins against said dash in order to gain support and leverage against the force against said sail assembly such that the sailboarder may more easily retain balance upon said sailboard.

3. The wind-propelled sailboard craft as defined in claim 2, further including a foot-operable rudder control assembly wherein the sailboarder may turn a rudder by manipulation of said rudder control assembly with his feet.

4. The wind-propelled sailboard craft as defined in claim 3, wherein said rudder control assembly comprises a plurality of intermeshed gears connected to said rudder.

5. The wind-propelled sailboard craft as defined in claim 2, wherein said sailboard craft includes a cockpit recessed in the upper surface thereof and wherein said dash is formed fore of said cockpit.

6. A wind-propelled sailboard craft, comprising:

a sailboard;

a sail assembly mounted on said sailboard;

a swivel mounting for swivably mounting said sail assembly on said sailboard;

a cockpit formed on an upper surface of said sailboard, said cockpit being configured to enable a sailboarder to stand upright therein, and said cockpit being positioned aft of said mounting such that the sailboarder may grasp said sail assembly with his hands to control said sail assembly; and a dash formed on and projecting upward from said upper surface of said sailboard proximal said mounting, said dash positioned such that a sailboarder operating said sailboard and grasping said sail assembly may place his shins against said dash in order to gain support and leverage against the pulling force of said sail assembly such that the sailboarder may more easily retain balance while operating said sailboard.

7. The wind-propelled sailboard craft as defined in claim 6, including a plurality of intermeshed gears formed on a floor of said cockpit, said gears being connected to a rudder, and said gears being manipulatable by the feet of the sailboarder, said manipulation causing movement of said rudder to steer said craft.

8. A wind-propelled sailboard craft, comprising:

a sailboard;

a sail assembly mounted on said sailboard;

a dash formed on the upper surface of said sailboard, said dash being positioned such that a sailboarder operating said craft and holding said sail assembly may place his legs against said dash for support.

9. The wind-propelled sailboard craft defined in claim 8, including a mounting which connects said sail assembly to said sailboard and wherein said dash is formed integrally on said sailboard aft of said mounting.

10. The wind-propelled sailboard craft defined in claim 8, wherein said dash is flexible so that a sailboarder's legs which are pressed against said dash will flex the dash in response to corresponding movement of the sailboarder's legs against said dash, said dash providing support to the sailboarder.

11. The wind-propelled sailboard craft defined in claim 10, wherein said dash comprises:

a lower portion extending upward and aftward from said upper surface of said sailboard; and an upper portion extending upward and forward from said lower portion and forming an elbow with said lower portion, said elbow providing a flex point whereby said upper portion may move relative to said lower portion when said upper portion is pressed by the legs of the sailboarder.

12. The wind-propelled sailboard craft defined in claim 8, including a cockpit formed on the upper surface of said sailboard aft of said dash such that the sailboarder may stand upright therein and pilot said craft from therein.

13. The wind-propelled sailboard craft defined in claim 8, including a foot-operable rudder control on said upper surface of said craft, said control operable by the sailboarder to move a rudder and thus steer said craft.

14. The wind-propelled sailboard craft defined in claim 13, wherein said foot-operable rudder control comprises a plurality of intermeshed gears which may be manipulated to move said rudder.

15. The wind-propelled sailboard craft defined in claim 14, wherein said gears comprise:

a left rudder gear exposed on said upper surface of said sailboard and rotatable by the left foot of the sailboarder;

a right rudder gear exposed on said upper surface of said sailboard and rotatable by the right foot of the sailboarder, said right rudder gear being directly intermeshed with said left rudder gear;

a first control gear directly intermeshed with one of said rudder gears; and a second control gear directly intermeshed with said first control gear, said second control gear being rigidly connected to said rudder.

16. A wind-propelled sailboard craft, comprising:

a sailboard;

a sail assembly mounted on said sailboard;

a movable rudder mounted on the bottom of said sailboard; and a foot-operable rudder control mechanism on said sailboard, said control mechanism comprising a plurality of foot-operable rudder gears, said rudder gears being meshed together and said rudder gears being connected to said rudder to control said rudder.

17. The wind-propelled sailboard craft defined in claim 16, wherein said control mechanism includes a control gear, said control gear being meshed to one of said rudder gears, and said control gear further being in mechanical connection with said rudder.

18. The wind-propelled sailboard craft defined in claim 16, wherein said rudder includes a shaft, said shaft defining an axis about which said rudder rotates, and said shaft being rigidly connected to a control gear and defining an axis therefore, said control gear being in mechanical connection with at least one of said foot-operable rudder gears.

19. The wind-propelled sailboard craft defined in claim 16, wherein said control mechanism is mounted in a cockpit, said cockpit being recessed into an upper surface of said sailboard.

20. The wind-propelled sailboard craft defined in claim 16, wherein said rudder is located proximal said control mechanism.

21. An apparatus for controlling a movable rudder on a wind-propelled sailboard craft comprising:

a plurality of foot-operable rudder gears exposed on an upper surface of a sailboard, said rudder gears comprising gear teeth and said rudder gears further a first rudder gear operable by the left foot of a sailboarder, and a second rudder gear operable by the right foot of the sailboarder, and said second rudder gear being meshed to said first rudder gear; and a plurality of control gears within said sailboard, said control gears comprising gear teeth and said control gears further comprising:

a first control gear meshed to one of said rudder gears, a second control gear meshed to said first control gear, said second control gear being rigidly connected to a rudder.

22. A method for supporting a sailboarder upon a wind-propelled sailboard craft, comprising the steps of:

providing a dash which projects upward from an upper surface of a sailboard craft;

standing upright upon said sailboard craft;

holding onto a sail assembly mounted on said upper surface; and placing a sailboarder's legs against said dash to gain support for maintaining balance on said craft and for obtaining leverage against the pull of said sail assembly caused by the wind.

* * * * *